United States Patent [19]

Gaiser

[11] 4,174,109

[45] Nov. 13, 1979

[54] ADHESIVELY BONDED HAND GRIP SLEEVE FOR HAND TOOLS AND THE LIKE

[76] Inventor: Conrad J. Gaiser, 24 S. 66th Pl., Long Beach, Calif. 90802

[21] Appl. No.: 904,538

[22] Filed: May 10, 1978

[51] Int. Cl.[2] ..... A63B 53/14

[52] U.S. Cl. ..... 273/81.6; 273/75; 74/558; 145/61 R

[58] Field of Search ..... 273/67 R, 67 A, 67 DB, 273/72 R, 73 R, 73 J, 75, 81 R, 81 B, 81 D, 81.4, 81.5, 81.6; 145/61 R, 61 K; 43/23; 74/551.9, 558, 558.5; 16/110 R; 15/143 R

[56] References Cited

U.S. PATENT DOCUMENTS

| | | | |
|---|---|---|---|
| 1,472,689 | 10/1923 | Skiles | 145/61 R X |
| 2,185,568 | 1/1940 | Rutner | 273/81 R X |
| 3,147,012 | 9/1964 | Sullivan | 273/81.2 X |
| 3,171,820 | 3/1965 | Volz | 260/2.5 |
| 3,311,375 | 3/1967 | Onions | 273/81.5 |
| 3,312,124 | 4/1967 | Meier et al. | 273/81 R X |
| 3,433,481 | 3/1969 | Tanguay | 273/72 R |
| 3,475,525 | 10/1969 | Peters | 264/101 |
| 3,500,572 | 3/1970 | Johnson | 273/81 R X |
| 3,549,505 | 12/1970 | Hanusa | 204/11 |
| 3,606,326 | 9/1971 | Sparks et al. | 273/81 R |
| 3,614,100 | 10/1971 | Spitz | 273/75 |
| 3,802,291 | 4/1974 | Young et al. | 273/81 R X |
| 3,845,954 | 11/1974 | Case | 273/81.5 X |
| 3,848,480 | 11/1974 | Oseroff et al. | 273/81.5 X |

FOREIGN PATENT DOCUMENTS

| | | | |
|---|---|---|---|
| 1270970 | 6/1968 | Fed. Rep. of Germany | 273/75 |
| 12661 | of 1904 | United Kingdom | 273/81.5 |
| 791030 | 2/1958 | United Kingdom | 273/81.5 |
| 1142073 | 2/1969 | United Kingdom | 273/75 |

*Primary Examiner*—Richard J. Apley

*Attorney, Agent, or Firm*—Fulwider, Patton, Rieber, Lee & Utecht

[57] ABSTRACT

There is disclosed a hand grip that is received over the hand gripping portion of a handle of a tool. The hand grip is formed of a spirally wrapped porous tape of a reticulated, open cell form having an uncompressed wall thickness no greater than about 5/16". The spiral wrap has a continuous open edge seam between adjacent tape wraps and is secured to the handle by an adhesive tape spiral wrap overlying the open edge seam and adjacent edges of the porous tape. This material, in contrast with sponge and sponge-like materials, has a low water holding capacity, less than about 20 volume percent. Preferably, the hand grip has a high degree of compressibility, typically with a compression resistance at about 80 percent deflection no greater than 1.5 to about 4 pounds per square inch. The low capillary and open-celled structure of the sleeve insures breathing of the sleeve under repeated compression which is adequate to expel most moisture during use. This breathing action is accentuated by the high compressibility of the foam.

7 Claims, 6 Drawing Figures

FIGURE 1
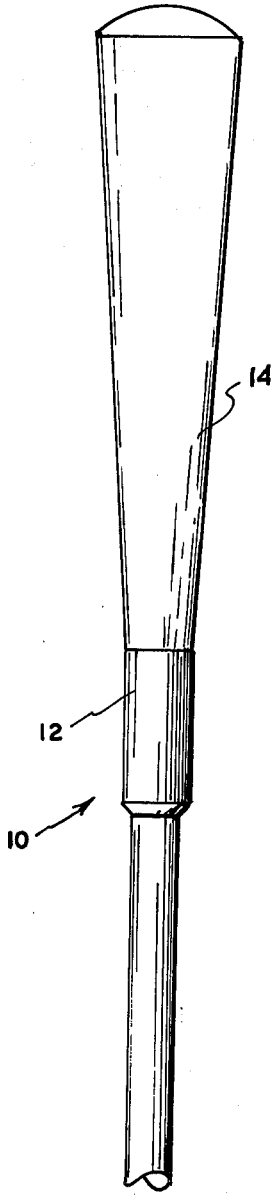
FIGURE 2
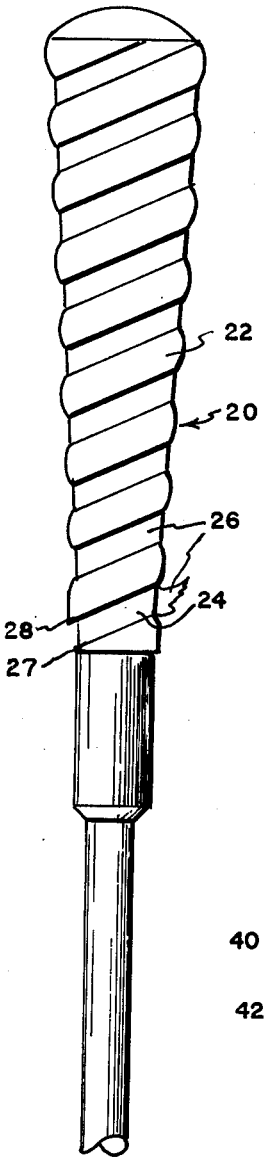
FIGURE 3
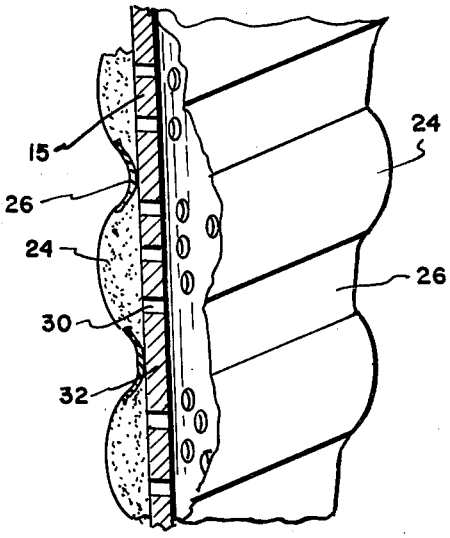
FIGURE 4
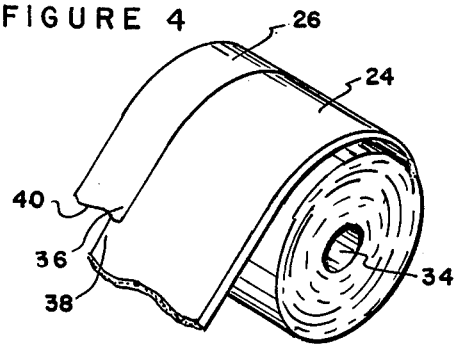
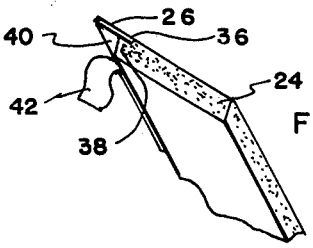
FIGURE 5
FIGURE 6
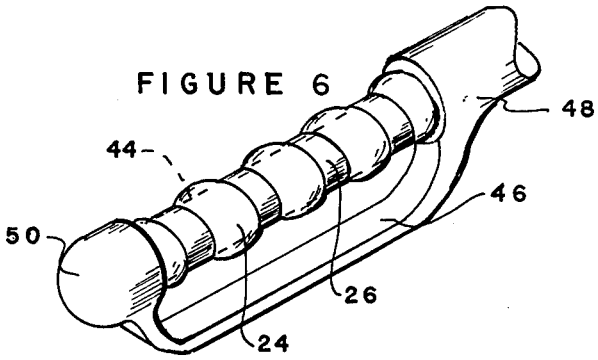

ADHESIVELY BONDED HAND GRIP SLEEVE FOR HAND TOOLS AND THE LIKE

BACKGROUND OF THE INVENTION

1. Field of the Invention

This invention relates to a hand grip for a hand tool and, in particular, to a grip for golf clubs and the like.

2. Brief Description of the Prior Art

A large number of devices such as sleeves, tapes and the like have been designed to provide a non-slipping, gripping surface for handles of hand tools and racket handles which often become coated with perspiration and oil. Popular among such devices are tapes of plastic foam or cotton which have an adhesive backing and a rough exterior surface to facilitate gripping. The adhesive backing, however, requires use of foams of a high structural resistance to tearing, thereby limiting the choice of useful materials. Separation is also experienced in the seam between adjacent wraps with these tapes.

Another device comprises a removable sleeve of a porous material such as terry cloth or sponge material shown in U.S. Pat. No. 3,614,100. While the latter device can be removed and washed and thereby does not suffer the disadvantage of becoming saturated with perspiration, this device is bulky and is not formed of readily compressible material. Consequently, the non-circular or asymmetric shape of a handle is obscured by the removable sleeve and the desired kinesthetic preception of the tool position in the user's hand is greatly inhibited or lost. Another disadvantage of terry cloth or sponge is the high water retention of these materials. Under strenuous use, such as during a competitive athletic contest, these materials can become water soaked, increasing greatly their weight (which tends to unbalance the tool) and decreasing their efficiency by preventing air circulation through the material.

BRIEF DESCRIPTION OF THE INVENTION

This invention comprises a hand grip for handles of tools, and in particular, for sports tools such as golf clubs and the like. The hand grip comprises a spirally wound tape or reticulated plastic foam with a spiral, open edge seam and an interspaced adhesive tape wrap overlying the spiral, open edge seam. The reticulated foam is, basically, a non-woven fibrous, compressible material. It can be obtained by treatment of open-celled, cellular plastic foam to remove the membraneous cell wall material without substantially affecting the interconnected rod-like strands of the foam's skeletal structure.

The material has a low density, typically about 1 to 3 pounds per cubic foot and has a very high degree of compressibility; the resistance to compression is preferably no greater than about 1.5 to about 40 psi at 80 percent deflection. The pore size of the foam can be from 10 to about 100 pores per inch, preferably from 10 to about 60 pores per inch. The open-celled, non-capillary structure of the foam and its low resistance to compressibility also insures that there is ventilation of the hand grip during use; the repetitious grasping action during use functioning to pump air through the structure, expelling water vapor and the like.

BRIEF DESCRIPTION OF THE DRAWINGS

The invention will be described with reference to the illustrations of which:

FIGS. 1 and 2 illustrate the application and use of the grip of the invention on a golf club handle;

FIG. 3 is a partial sectional view of another application of the invention;

FIGS. 4 and 5 are views of a typical tape assembly useful for the invention; and FIG. 6 is a view of another application of the hand grip of the invention.

DESCRIPTION OF THE PREFERRED EMBODIMENTS

The application and use of the hand grip of the invention is illustrated in FIGS. 1 and 2 as applied to a hand tool such as a golf club 10. The club has a handle 12 with a tapered hand gripping portion 14 which is commonly covered with a material having a rough surface to enhance grasping of the tool. The handle 14 is of a longitudinally tapered, circular cross-section.

The hand grip 20 of the invention comprises a generally spirally wound tape 22 formed of a reticulated foam. The foam has 100 percent open cells. The material is of a reticulated, three-dimensional structure. This structure is formed by reticulation treatment of an open-celled, cellular plastic foam. The spirally wound tape 22 has an open edge seam 24 between adjacent wraps as shown at the lower end of the grip 20. An adhesively backed tape 26 is applied in a spiral wrap over the open edge seam 24 with its edges overlying the spaced-apart edges 27 and 28 of the form tape 22. The completed handle has interspaced spiral wraps of reticulated foam and adhesive backed tape.

The reticulated open-celled material for the hand grip has a low capillary structure as reflected by a low water holding capacity. Typically, the maximum amount of water retained by the material is no greater than about 10 volume percent. The limited water holding capacity insures that the material readily "breathes" in use and moisture is expelled rather than retained, thereby retaining the natural balance of the tool and firmness in grip of the hand grip.

The following tabulates experimental data on the water retention of the foam:

| | Reticulated Foam | | Sponge* | |
|---|---|---|---|---|
| Dry weight | 6.4 | grams | 20.4 | grams |
| Container weight | 5.7 | grams | 5.7 | grams |
| Wet weight | 40.3 | grams | 236.7 | grams |
| Weight of water | 28.2 | grams | 210.6 | grams |
| Foam volume, cubic inches | 18.28 | | 18.75 | |
| Volume percent water | 9.4% | | 68.5% | |

*A common cellulose kitchen sponge.

The reticulated foam is thus demonstrated to have only a fraction of the water absorbency of a sponge-type product.

The reticulated foams are flexible, compressible plastic foams having three-dimensional structure of skeletal strands. The foam is available with a range of pore size from 10 to about 100 pores per inch. Preferably, the foams having a medium to coarse texture, i.e., those from 60 to about 10 pores per inch are employed. The foams are commercially available from suppliers such as Scott Paper Co., 1500 East Second Street, Chester, PA.

A method for reticulation of open-celled plastic foams is described in U.S. Pat. No. 3,475,525 by passing a heated gas through an open-celled foam to heat the foam and melt its membraneous cell walls without melting the skeletal network strands of the foam structure. Another reticulation method is described in U.S. Pat. No. 3,476,933 using an oxidizing agent to dissolve the membraneous cell walls.

Various plastic foams can be reticulated such as foams of polyurethane, polyester, polyether, polyester base urethane, polyether base urethane, or polyolefins, e.g., of polypropylene. Of these, reticulated foams of polyurethane and or polyether base urethane are most commonly available and are very suitable for use in the invention. The polyether base urethane reticulated foams are particularly preferred because of their high resistance to oils, moisture and solvents.

FIG. 3 shows an embodiment of the invention in which the wrap of the reticulated foam tape 24 and interspaced adhesively backed tape 26 are applied over a handle 15. The handle 15 is hollow-form with a thin wall 32 having a plurality of apertures 30. The apertures permit free circulation of air when the handle is grasped and the porous foam tape is compressed and released. This promotes expulsion of water from the handle grip of the invention.

The reticulated foam tape 24 and the adhesively backed tape 26 can be packaged as an assembly, as shown in FIG. 4. The assembly can be rolled on a sleeve 34. One edge 36 of the adhesive tape 26 can overlie an edge 38 of the reticulated foam tape and is adhesively bonded thereto. As shown in FIG. 5, the exposed undersurface 40 of the adhesive tape can have a protective layer of a peel tape 42 which is removed when the tapes are applied to a handle.

The invention has particular application to tool handles which are tapered or which, although of uniform cross section, cannot readily receive a sleeve type grip. An example of such a handle is shown in FIG. 6 where the cylindrical handle 44 is surrounded by a guard 46 that extends from a forward sleeve 48 to an integral rear end cap 50. The invention of the helical continuous wrapping of the interspaced reticulated foam tape 24 and adhesively backed tape 26 can be readily applied to this handle without the necessity to dismantle the assembly of handle 44 and guard 46.

The flexible reticulated open-celled foam employed for hand grip tape 24 is preferably, readily compressible and capable of substantial deflection under minor compressive loading. The ease of compressibility of the aforementioned materials can be expressed by the amount of force required to compress the materials to a designated deflection. In the instant invention materials having compressive loadings from 1.4 to about 4.0 pounds per square inch at 80 percent deflection are suitable for use in the invention.

The reticulated polyurethane foam material also has a very high tensile strength compared to other flexible foam materials. Typically the material has a tensile strength from 35 to about 50 psi. This high tensile strength is of substantial benefit since it insures that the hand grip does not readily tear when applied to a handle or when in use.

The hand grip of the invention has characteristics and achieves results not accomplished by any prior art device. The hand grip is formed of inexpensive and readily available materials. Since the material is highly compressible, there is no significant loss of kinesthetic preception of the tool position when grasped in a user's hand. The porous structure of the material also provides a coarse or rough exterior surface which can be readily grasped by a user without any discomfort and a similar surface engages the tool handle with maximum frictional engagement thereby insuring against unintentional rotation of the handle in the user's hand without adhesively attaching the foam tape to the tool handle.

The non-capillary, porous, open-celled structure of the material also insures a very desirable ventilation in use. The material undergoes repeated compression and expansion, experiencing approximately an eight fold volumetric change as the user's grip is relaxed and tightened during use. This imparts a pumping action to the hand grip, forcefully circulating air through the hand grip and evaporating moisture and oil. As a consequence, the hand grip can be employed on a tool such as a tennis racket handle and the like over prolonged periods of strenuous exercise without causing any discomfort or tendency to slip.

Finally, the extremely low density of the material employed for manufacture of the hand grip insures that there will be minimal effect of the balance of the tool. Typically a hand grip for use in accordance with the invention weighs less than about 0.25 ounce and this weight is so minimal that it does not disturb the natural balance of the tool.

The invention has been described with reference to the illustrated and presently preferred embodiments thereof. It is not intended that the invention be unduly limited by this description of the illustrated embodiment. Instead, it is intended that the invention be defined by the means, and their obvious equivalents set forth in the following claims.

What is claimed is:

1. A manual tool having a handle with a hand grip for grasping by a user and a cover member comprising a porous tape spiral wrap about said handle with a continuous open-edge seam between adjacent tape wraps and being secured to said handle by an adhesive tape spiral wrap overlying said open-edge seam and adjacent edges of said porous tape thereby resulting in a gripping surface of interspaced spiral wraps of said adhesive tape and said porous tape, said porous tape formed of a reticulated plastic foam.

2. The tool of claim 1 wherein said plastic foam is a polyurethane foam.

3. The tool of claim 1 wherein said plastic foam is an ester-base polyurethane.

4. The tool of claim 1 wherein said plastic foam is an ether-base polyurethane.

5. The tool of claim 1 which comprises a golf club having an elongated handle and a tapered hand gripping section which receives said hand grip.

6. The tool of claim 1 having a non-circular cross-section for kinesthetic sensing of the tool orientation.

7. The tool of claim 6 wherein said porous material has a compressive resistance at 80 percent deflection no greater than about 4 pounds per square inch.

* * * * *